United States Patent [19]

Cote

[11] Patent Number: 4,925,354

[45] Date of Patent: May 15, 1990

[54] APPARATUS AND METHOD FOR APPLYING ADHESIVE TO BOOKS

[75] Inventor: Kevin L. Cote, Dayton, Ohio

[73] Assignee: AM International Incorporated, Chicago, Ill.

[21] Appl. No.: 419,014

[22] Filed: Oct. 10, 1989

[51] Int. Cl.[5] ..... B42C 9/00

[52] U.S. Cl. ..... 412/8; 118/259; 118/679; 412/11; 412/37

[58] Field of Search ..... 412/8, 11, 37, 900, 412/5; 118/672, 673, 668, 669, 324, 244, 104, 123, 259, 679; 156/390, 556, 477.1

[56] References Cited

U.S. PATENT DOCUMENTS

| | | | |
|---|---|---|---|
| 2,523,860 | 9/1950 | Budden | 412/8 |
| 3,223,436 | 12/1965 | Becker | 412/8 |
| 3,672,326 | 6/1972 | Schulze | 118/679 |
| 3,919,971 | 11/1975 | Lubeck | 118/259 |
| 4,380,967 | 4/1983 | Matt | 118/669 |
| 4,419,384 | 12/1983 | Kane et al. | 118/324 |
| 4,527,510 | 6/1985 | Arndt | 118/669 |

*Primary Examiner*—Paul A. Bell
*Assistant Examiner*—Hwei-Siu Payer
*Attorney, Agent, or Firm*—Tarolli, Sundheim & Covell

[57] ABSTRACT

An apparatus includes a conveyor for moving books in a spaced apart relationship along a predetermined path along which each book receives a length of adhesive. A roller is supported for rotation about its longitudinal central axis and has an outer cylindrical surface for receiving lengths of adhesive. A glue gun is provided for applying adhesive to the outer surface of the roller. The adhesive applied to the outer surface of the roller is of lengths equal to lengths of adhesive to be applied to the books. The lengths of adhesive are spaced apart by nonadhesive lengths. A nonadhesive length is equal to the spacing between adjacent lengths of adhesive on the books. A length of adhesive is transferred from the outer surface of the roller to a book when the book moves along the predetermined path and into contact with the length of adhesive.

18 Claims, 1 Drawing Sheet

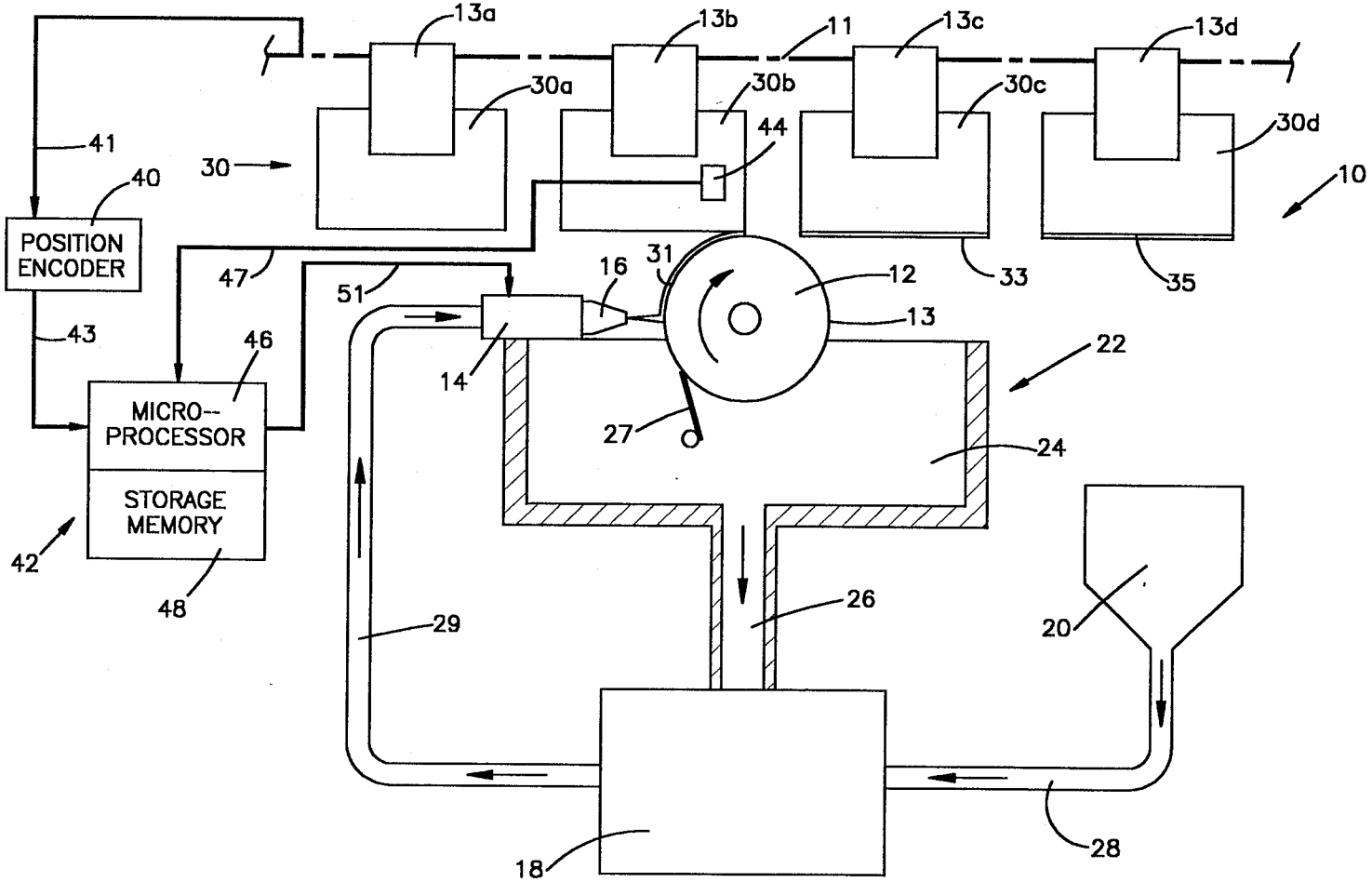
10
30d
13d
35
22
24
20
28
30c
33
13c
12
13
26
11
30b
44
13b
31
16
27
18
30a
13a
14
29
51
47
46
MICRO-PROCESSOR
STORAGE MEMORY
48
30
40
POSITION ENCODER
41
43
42

APPARATUS AND METHOD FOR APPLYING ADHESIVE TO BOOKS

BACKGROUND OF THE INVENTION

1. Technical Field

The present invention relates to applying adhesive to books which are conveyed along a predetermined path such as in a bindery line, and is particularly directed to an apparatus and method for applying a length of adhesive to a first book and another length of adhesive to a second book spaced a predetermined distance apart from the first book as the books are being conveyed.

2. Background Art

Glue applying systems for applying adhesive to books are well known in the art. Typically, such a glue applying system includes a roller which is rotatable about its longitudinal central axis and which has a portion of its periphery located in a glue supply containing a supply of adhesive. As the roller rotates, its outer surface picks up adhesive. The books are moved into contact with the adhesive on the outer surface of the rotating roller. When the books come in contact with the adhesive, the adhesive is transferred from the outer surface of the rotating roller to the moving books.

A problem associated with the glue applying system just described is that some adhesive on the outer surface of the rotating roller may not transfer to the books. The adhesive that does not transfer to the books may result in a buildup of excessive adhesive on the outer surface of the rotating roller. A buildup of excess adhesive on the outer surface of the rotating roller is undesirable because this affects the proper transfer of adhesive from the rotating roller to the books and results in increased adhesive consumption than otherwise would be if there was no buildup of excess adhesive.

A known way to minimize the buildup of excess adhesive on the outer surface of the rotating roller is to use one or more scrapers located around the outer periphery of the rotating roller. Through the operation of an arrangement of mechanical cams, the scraper is moved into and out of contact with the outer surface of the rotating roller to remove the excess adhesive on the rotating roller. A disadvantage in using the scrapers is that the combination of the mechanical cams and the scrapers is relatively large in size. The result is a relatively large glue applying system which occupies a relatively large amount of space.

SUMMARY OF THE INVENTION

In accordance with the present invention, an apparatus comprises means for moving books in a spaced apart relationship along a predetermined path along which each book receives a length of adhesive. A roller is rotatable about its longitudinal central axis and has an outer cylindrical surface for receiving lengths of adhesive. Means is provided for supporting the roller so that the outer surface of the roller rotates in the predetermined path. A glue gun is provided for applying adhesive to the outer surface of the roller. Means for controlling the glue gun is provided to apply adhesive to the outer surface of the roller. The adhesive being applied to the outer surface of the roller is of lengths equal to lengths of adhesive to be applied to the books. The lengths of adhesive are spaced apart by nonadhesive lengths. A nonadhesive length is equal to the spacing between adjacent lengths of adhesive on the books. The adhesive is transferred from the outer surface of the roller to a book when the book moves along the predetermined path and into contact with the adhesive on the roller.

Preferably, the means for controlling the glue gun includes a microprocessor for providing a control signal to control operation of the glue gun in response to an output signal from a book sensor and an output signal from a position encoder. The book sensor may be a photocell and is provided for sensing the presence of a book adjacent the roller, and the output signal from the photocell is indicative of the presence of a book adjacent the roller. The position encoder senses the actual position of the means for moving books, and the output signal from the position encoder is indicative of the actual position of the means for moving books.

BRIEF DESCRIPTION OF THE DRAWING

The foregoing and other features and advantages of the present invention will become apparent to one skilled in the art to which the present invention relates from reading the following description of a preferred embodiment in conjunction with the accompanying schematic drawing of an apparatus, constructed in accordance with the present invention, for applying adhesive to books.

DESCRIPTION OF A PREFERRED EMBODIMENT

The present invention relates to an apparatus and method for applying adhesive to books. The specific use and construction of the apparatus of the present invention may vary. The apparatus of the present invention is particularly suitable for use in a glue applying system of a bindery line and will be described herein as applied thereto.

As illustrated in the drawing, a conveyor 11 is provided for moving books along a predetermined path.

A number of books 30 individually designated as 30*a*, 30*b*, 30*c*, and 30*d* in the drawing are conveyed along the predetermined path by means of the conveyor 11. The conveyor 11 has a number of book clamps 13 individually designated in the drawing as 13*a*, 13*b*, 13*c*, and 13*d* for clamping and holding the books as the books are transported along the predetermined path. The conveyor 11 has a conveyor pitch which is defined as the distance between the center of a book clamp and the center of an adjacent book clamp along the predetermined path. The structure and operation of book clamps are well known in the art and, therefore, will not be described herein.

A glue applying system 10 constructed in accordance with the present invention is illustrated in the drawing. The glue applying system 10 includes a glue wheel in the form of a roller 12 having an outer surface 13. The roller 12 is supported for rotation about its longitudinal central axis and has a circumferential length preferably equal to the conveyor pitch of the conveyor 11. The glue applying system 10 further includes a high pressure glue gun 14 having a nozzle 16 from which lengths of adhesive are extruded. The glue applying system 10 further includes an adhesive pump 18 for pumping adhesive from a glue supply 20 and from a glue recovery system 22.

The glue recovery system 22 includes a recovery reservoir 24 to which one end of an adhesive return line 26 is connected. The other end of the adhesive return line 26 is connected to an input port of the adhesive pump 18. The glue supply 20 is connected to one end of an adhesive supply line 28. The other end of the adhesive supply line 28 is connected to another input port of the adhesive pump 18. An output port of the adhesive pump 18 is connected through an adhesive supply line 29 to an input port of the glue gun 14. An output port of the glue gun 14 is connected to the entrance side of the nozzle 16. The exit side of the nozzle is adjacent to the roller 12 and is directed toward the outer surface 13 of the roller 12.

The glue applying system 10 further includes a position encoder 40 for sensing on line 41 the actual position of the conveyor 11 and for providing an output signal on line 43 indicative thereof. The output signal on line 43 from the position encoder 40 is connected to an input of a control unit 42. A book sensor 44 in the form of a photocell is provided for sensing the presence of a book adjacent the roller 12 and for providing an output signal on line 47 indicative thereof. The output signal on line 47 from the photocell 44 is connected to an input of the control unit 42.

The control unit 42 includes a microprocessor 46 and a storage memory 48. The storage memory 48 contains data such as the length of a book to which a length of adhesive is to be applied, the size of the lengths of adhesive to be applied to the books, and the size of nonadhesive gaps to be formed between adjacent lengths of adhesive to be applied to the books. The structure and operation of the microprocessor 46 and the storage memory 48 and the interaction therebetween are well known and therefore, will not be described herein.

During operation, the microprocessor 46 monitors the output signal on line 47 from the photocell 44 and the output signal on line 43 from the position encoder 40. In response to the output signal from the photocell 44 and the output signal from the position encoder 40, the microprocessor 46 generates an output signal on line 51 to control operation of the glue gun 14. The output signal on line 51 from the microprocessor 46 depends upon the output signal from the photocell 44 and the output signal from the position encoder 40 and also the data stored in the storage memory 48.

The output signal on line 51 from the microprocessor 46 turns on the glue gun 14 only when the signal on line 43 indicates that the conveyor 11 is in an acceptable position for the glue gun 14 to turn on and the signal on line 47 indicates that a book is actually present adjacent the roller 12 for receiving adhesive from the outer surface 13 of the roller 12. The glue gun 14 does not turn on to apply lengths of adhesive to the outer surface 13 of the roller 12 when either the conveyor 11 is not in an acceptable position for the glue gun 14 to turn on or a book is not actually present adjacent the roller 12 for receiving adhesive from the outer surface 13 of the roller 12. Thus, the glue gun 14 is controlled by the output signal on line 51 from the microprocessor 46 to apply adhesive to the outer surface 13 of the roller 12.

The adhesive applied to the outer surface 13 of the roller 12 is of lengths equal to lengths of adhesive to be applied to the books. The lengths of adhesive are extruded from the nozzle 16 of the glue gun 14. The adhesive is applied to the outer surface 13 of the roller 12 as the roller 12 rotates about its longitudinal central axis. A length of adhesive is transferred from the outer surface 13 of the roller 12 to a book as the roller 12 rotates about its longitudinal central axis and the book moves along the predetermined path and into contact with the adhesive. The glue gun 14 is also controlled by the output signal on line 51 from the control unit 42 to space the lengths of adhesive apart by nonadhesive lengths. A nonadhesive length is equal to the spacing between adjacent lengths of adhesive on the books.

While the books 30 are conveyed along the predetermined path, each book is moved into contact with the outer surface 13 of the roller 12. As shown in the drawing, the book **30*a* is a book to which adhesive is yet to be applied. The book 30*b* is in contact with a portion 31 of a length of adhesive on the outer surface 13 of the roller 12. The book 30*c* is a book to which a length of adhesive 33 has been applied. The book 30*d* is a book to which a length of adhesive 35 has been applied. Thus, as shown in the drawing, the books 30*a*, 30*b*, 30*c* and 30*d*** are being conveyed in a direction from the left to the right.

A glue wheel scraper 27 is mounted adjacent to the roller 12 in a position as shown in the drawing. The scraper 27 is positioned so that a portion of the scraper 27 is in contact with the outer surface 13 of the roller 12. As the roller 12 rotates, the scraper 27 acts to scrape off adhesive on the outer surface 13 of the roller 12 which did not transfer to a book. After the adhesive is removed from a portion of the outer surface 13 of the rotating roller 12, that portion of the outer surface 13 of the roller 12 then moves into a position relative to the nozzle 16 of the glue gun 14 to receive another extruded length of adhesive from the nozzle 16 of the glue gun 14.

The removed adhesive from the outer surface 13 of the roller 12 is recovered in the recovery reservoir 24. The recovered adhesive in the reservoir 24 is then returned through the adhesive return line 26 to the adhesive pump 18. The adhesive pump 18 then pumps adhesive from the glue pot 20 and the recovered adhesive from the recovery reservoir 24 through the adhesive supply line 29 to the glue gun 14. Thus, the adhesive recovered from the recovery reservoir 24 is recycled and is again ready to be extruded from the nozzle 16 of the glue gun 14.

It will become apparent to one skilled in the art that the actual length of a length of adhesive can be controlled by controlling the speed of rotation of the roller 12 about its longitudinal central axis. Although only one glue applying system is shown, it is understood that a number of glue applying systems may be arranged adjacent to each other along the bindery line. By using the glue applying system 10 as described, a build up of excess adhesive on the outer surface 13 of the roller 12 is minimized and possibly eliminated. When build up of excess adhesive on the outer surface 13 of the roller 12 is minimized, the overall consumption of adhesive is minimized and the likelihood of improper transfer of adhesive from the roller 12 to the books 30 is reduced. Further, the actual physical space occupied by the glue gun system 10 is reduced since mechanical cams associated with conventional scrapers are not required.

This invention has been described above with reference to a preferred embodiment. Modifications and alterations may become apparent to one skilled in the art upon reading and understanding this specification. It is intended to include all such modifications and alterations within the scope of the appended claims.

Having described a specific preferred embodiment of the invention, the following is claimed:

1. An apparatus comprising:

means for moving books in a spaced apart relationship along a predetermined path along which each book receives a length of adhesive;

a roller rotatable about its longitudinal central axis and having an outer cylindrical surface for receiving lengths of adhesive;

means for supporting said roller so that said outer surface of said roller rotates in said predetermined path; and a glue gun for applying adhesive to said outer surface of said roller;

means for controlling said glue gun to apply adhesive to said outer surface of said roller, the adhesive being applied to said outer surface of said roller being of lengths equal to lengths of adhesive to be applied to the books, the lengths of adhesive being spaced apart by nonadhesive lengths, a nonadhesive length being equal to the spacing between adjacent lengths of adhesive on the books, the adhesive being transferred from said outer surface of said roller to a book when the book moves along said predetermined path and into contact with said adhesive on said roller.

2. The apparatus of claim 1 further including means for removing from said outer surface of said roller adhesive which did not transfer to a book.

3. The apparatus of claim 2 further including means for recovering the removed adhesive from said outer surface of said roller.

4. The apparatus of claim 3 further including means for returning the recovered adhesive to said glue gun.

5. The apparatus of claim 1 wherein said control means includes a book sensor for sensing the presence of a book at said roller and for providing an output signal indicative thereof.

6. The apparatus of claim 5 wherein said book sensor is a photocell.

7. The apparatus of claim 5 wherein said control means includes a position encoder for sensing the actual position of said moving means and for providing an output signal indicative thereof.

8. The apparatus of claim 7 wherein said control means includes a microprocessor for providing a control signal to control operation of said glue gun in response to said output signal from said book sensor and said output signal from said position encoder.

9. An apparatus comprising:

means for moving books in a spaced apart relationship along a predetermined path along which each book receives at least one length of adhesive;

a first roller rotatable about its longitudinal central axis and having an outer cylindrical surface for receiving lengths of adhesive;

a second roller rotatable about its longitudinal central axis and having a outer cylindrical surface for receiving lengths of adhesive;

a first glue gun for applying adhesive to said outer surface of said first roller, the adhesive being applied to said outer surface of said first roller being of lengths equal to first lengths of adhesive to be applied to the books, the first lengths of adhesive being spaced apart by first nonadhesive lengths, the first nonadhesive lengths being equal to the spacing between adjacent first lengths of adhesive on the books, a first length of adhesive being transferred from said outer surface of said first roller to a book when the book moves along said predetermined path and into contact with the first length of adhesive; and a second glue gun spaced apart at a predetermined distance from said first glue gun for applying adhesive to said outer surface of said second roller, the adhesive being applied to said outer surface of said second roller being of lengths equal to second lengths of adhesive to be applied to the books, the second lengths of adhesive being spaced apart by second nonadhesive lengths, the second nonadhesive lengths being equal to the spacing between adjacent second lengths of adhesive on the books, a second length of adhesive being transferred from said outer surface of said second roller to a book when the book moves along said predetermined path and into contact with the second length of adhesive.

10. The apparatus of claim 9 further including means for removing from at least one of said first and second rollers any adhesive which did not transfer to a book.

11. The apparatus of claim 10 further including means for recovering the removed adhesive from said at least one of said first and second rollers.

12. The apparatus of claim 11 further including means for returning the recovered adhesive to at least one of said first and second glue guns.

13. A method for applying lengths of adhesive to books spaced apart from one another, said method comprising the steps of:

moving the books in a spaced apart relationship along a predetermined path along which each book receives a length of adhesive;

supporting a roller for rotation about its longitudinal central axis so that its outer cylindrical surface of said roller rotates in said predetermined path;

applying adhesive to said outer surface of said roller as said roller rotates about its longitudinal central axis, the adhesive being applied to said outer surface of said roller being of lengths equal to lengths of adhesive to be applied to the books;

spacing the lengths of adhesive apart by nonadhesive lengths, a nonadhesive length being equal to the spacing between adjacent lengths of adhesive on the books; and transferring a portion of a length of adhesive from said outer surface of said roller to a book when the book moves along said predetermined path and into contact with the portion of the length of adhesive.

14. The method of claim 13 further including the step of removing adhesive which did not transfer to a book from said outer surface of said roller.

15. The method of claim 14 further including the step of recovering the removed adhesive from said outer surface of said roller.

16. The method of claim 13 further including the step of sensing the presence of a book at the roller and providing a first output signal indicative thereof.

17. The method of claim 16 further including the step of sensing the actual position of the books along said predetermined path and providing a second output signal indicative thereof.

18. The method of claim 17 further including the step of controlling the applying of adhesive to said outer surface of said roller as said roller rotates about its longitudinal central axis in response to said first and second output signals.

* * * * *